US005746647A

United States Patent [19]

Huang

[11] Patent Number: 5,746,647

[45] Date of Patent: May 5, 1998

[54] SLEEVE FLANGE TYPE MOUNTING DEVICE FOR MOUNTING A GRINDING WHEEL ON A SPINDLE OF A GRINDING MACHINE

[75] Inventor: Shih-chung Huang, Panchiao, Taiwan

[73] Assignee: China Grinding Wheel Corporation, Taiwan

[21] Appl. No.: 745,514

[22] Filed: Nov. 12, 1996

[51] Int. Cl.[6] ..... B24D 5/16; B24B 45/00

[52] U.S. Cl. ..... 451/343

[58] Field of Search ..... 451/343, 342, 451/550, 551, 541

[56] References Cited

U.S. PATENT DOCUMENTS

| | | | |
|---|---|---|---|
| 430,270 | 6/1890 | Cook | 451/343 |
| 1,218,689 | 3/1917 | Nichols | 451/343 |
| 2,958,165 | 11/1960 | Hoffman | 451/343 |
| 3,662,620 | 5/1972 | Carlson | 451/343 |

FOREIGN PATENT DOCUMENTS

| | | | |
|---|---|---|---|
| 2004567 | 1/1987 | Japan | 451/343 |
| 0024573 | 11/1911 | United Kingdom | 451/343 |

*Primary Examiner*—Robert A. Rose
*Attorney, Agent, or Firm*—Parkhurst, Wendel & Burr, L.L.P.

[57] ABSTRACT

A sleeve flange type mounting device for mounting a grinding wheel on a spindle of a grinding machine consists of a sleeve flange defining a sleeve portion and a flange portion, a pressing plate fitted on the sleeve portion for clamping the grinding wheel on the flange portion, a cover fitted on the pressing plate, three balance weights received in a circular recess defined by the pressing plate and each having a first arc-shaped side abutting against a far wall near a circumferential periphery of the pressing plate and a second arc-shaped side abutting against a circumferential periphery of the cover, and a nut threadedly engaging an extremity of the sleeve portion and exerting a compressive force on the cover.

4 Claims, 3 Drawing Sheets

SLEEVE FLANGE TYPE MOUNTING DEVICE FOR MOUNTING A GRINDING WHEEL ON A SPINDLE OF A GRINDING MACHINE

FIELD OF THE INVENTION

The present invention generally is related to a mounting device for mounting a grinding wheel on a spindle of a grinding machine, and particularly to a sleeve flange type mounting device for mounting a grinding wheel on a spindle of a grinding machine.

BACKGROUND OF THE INVENTION

There are two types of mounting device, i.e., a straight flange type and a sleeve flange type, which can be used to mount a grinding wheel on a spindle of a grinding machine.

FIGS. 4 and 5 show a conventional sleeve flange type mounting device 7 (hereafter referred as "mounting device") for mounting a grinding wheel 80 on a spindle (not shown) of a grinding machine (not shown), wherein FIG. 5 is a cross-sectional view taken from line 5—5 of FIG. 4. The mounting device 7 includes a sleeve flange 70 defining a flange portion 702 and a sleeve portion 704. The flange portion 702 defines a circular groove 73 for accommodating a plurality (three as shown in FIG. 4) of balance weights 74. The grinding wheel 80 is mounted on the sleeve flange 70 by extending the sleeve portion 704 through the grinding wheel 80 and then a pressing plate 77 and a nut 78, wherein the nut 78 is threadedly engaged with an outer threaded portion 782 defined on an extremity of the sleeve portion 704 and exerts a compressive force on the grinding wheel 80 via the pressing plate 77 to tightly mount the grinding wheel 80 on the sleeve flange 70.

The sleeve flange 70 furthermore defines a central tapered hole 72 and an inner threaded portion 722 whereby the mounting device 7 together with the grinding wheel 80 can be attached to an extremity of the spindle which has a corresponding structure.

Each of the balance weights 74 defines an axially extending hole 742 having a thread formed thereon and a radially extending hole 751 orthogonal to and in communication with the axially extending hole 742. A steel ball 76 is received in the radially extending hole 751 and in contact with an inside wall of the groove 73. A screw 75 is threadedly received with the hole 742. When the screw 75 is received in the hole 742 at a position as shown in FIG. 5, a front end of the screw 75 radially pushes the steel ball 76 against the inside wall of the groove 73. As the screw 75 is further screwed in, the steel ball 76 will cause the screw 75 together with the balance weight 74 to be pushed radially towardly an outside wall of the groove 73 whereby the balance weight 74 will tightly engage with the outside wall of the groove 73 so that the balance weight 74 is locked in place. Alternatively, when the screw 75 is turned to move away from the steel ball 76, the locking of the balance weight 74 is released so that the position of the balance weight 74 can be adjusted along the circular groove 73.

After the grinding wheel 80 is mounted on the spindle by means of the mounting device 7, a static balance and a dynamic balance of the grinding wheel 80 together with the mounting device 7 are tested. An optimum static and dynamic balance of the grinding wheel 80 together with the mounting device 7 can be obtained by adjusting the position of the balance weights 74.

The conventional mounting device 7 for mounting a grinding wheel on a spindle of a grinding machine has the disadvantages as set forth below.

When the mounting device 7 is newly used, there is substantially no difficulty to move the balance weights 74 along the groove 73. However, after a period of use, the particles/dust generated due to the grinding wheel 80 performing a grinding operation will enter the groove 73 and accumulate and harden therein. Such particles/dust accumulated and hardened in the groove 73 cause movement of the balance weights 74 along the circular groove 73 to become difficult. Thus, each time before a new grinding wheel 80 is taken to replace a worn one, a cleaning up operation should be performed on the groove 73 to remove the dust/particles accumulated and hardened therein whereby the position of the balance weights 74 can be re-adjusted to enable the new grinding wheel together with the mounting device 7 to have its optimum static and dynamic balance. To clean the groove 73 firstly all of the screws 75 must be loosened in sequence to cause them to move away respectively from the steel balls 76, and, then the balance weights 74 are taken out of the groove 73. To turn the all of the screws 75 in sequence to make them move away respectively from the steel balls 76 is laborious and time-consuming.

Moreover, the particles/dust may enter the hole 751 and harden therein via a gap between the balance weights 74 and the inside wall of the groove 73. Such particles/dust entering the hole 751 and hardened therein may block the passage for the steel balls 76 to move and hold the steel balls 76 in the position locking the balance weights 74 in place. If this happens, adjusting the position of the balance weights 74 becomes very troublesome.

The present invention therefore is aimed to provide an improved sleeve flange type mounting device for mounting a grinding wheel on a spindle of a grinding machine to mitigate and/or obviate the aforementioned problems.

SUMMARY OF THE INVENTION

An objective of the present invention is to provide a sleeve flange type mounting device for mounting a grinding wheel on a spindle of a grinding machine wherein to clean a groove for accommodating the balance weights in the sleeve flange type mounting device in accordance with the present invention can be conveniently achieved.

Another objective of the present invention is to provide a sleeve flange type mounting device for mounting a grinding wheel on a spindle of a grinding machine wherein no steel ball is needed in the sleeve flange type mounting device in accordance with the present invention to achieve the locking of the balance weights so that the problem of the prior art to adjust the position of the balance weights becomes very troublesome due to the passage for the steel balls to move being blocked so that the steel balls are held on the position locking the balance weights 74 in place will not happen in the present invention.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
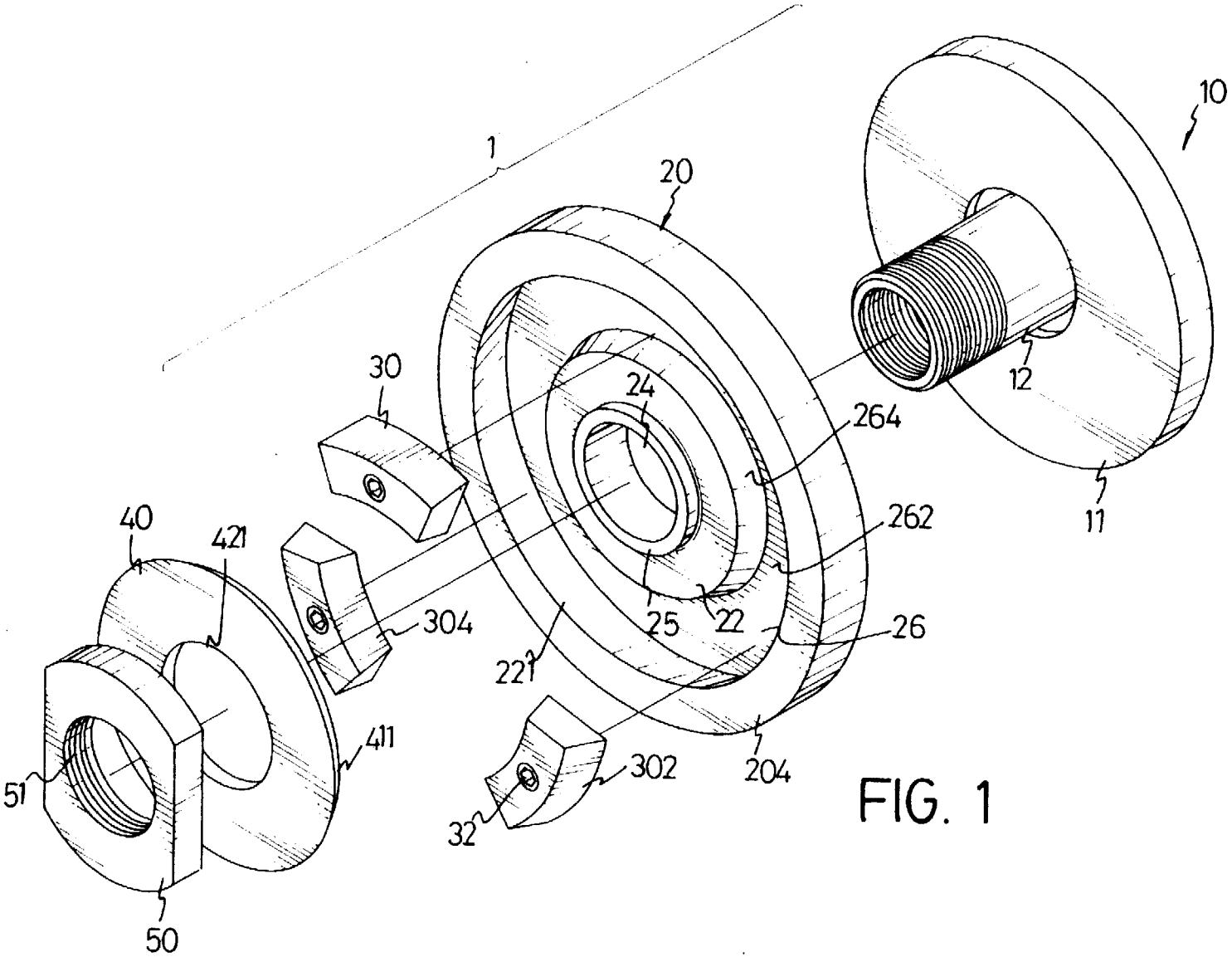
FIG. 1 is a front-right-top perspective, exploded view showing the elements for constituting a sleeve flange type mounting device for mounting a grinding wheel on a spindle of grinding machine in accordance with the present invention.
Figure 3:
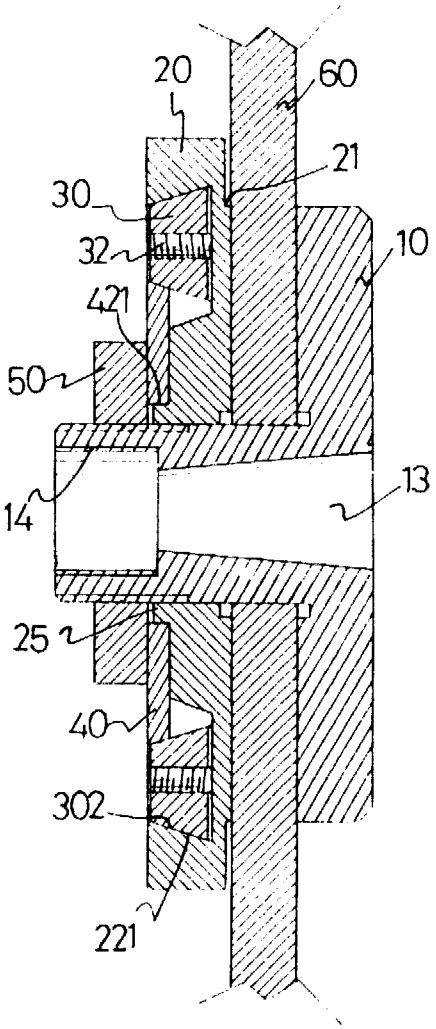
FIG. 3 is a cross-sectional view taken from line 3—3 of FIG. 2.
Figure 2:
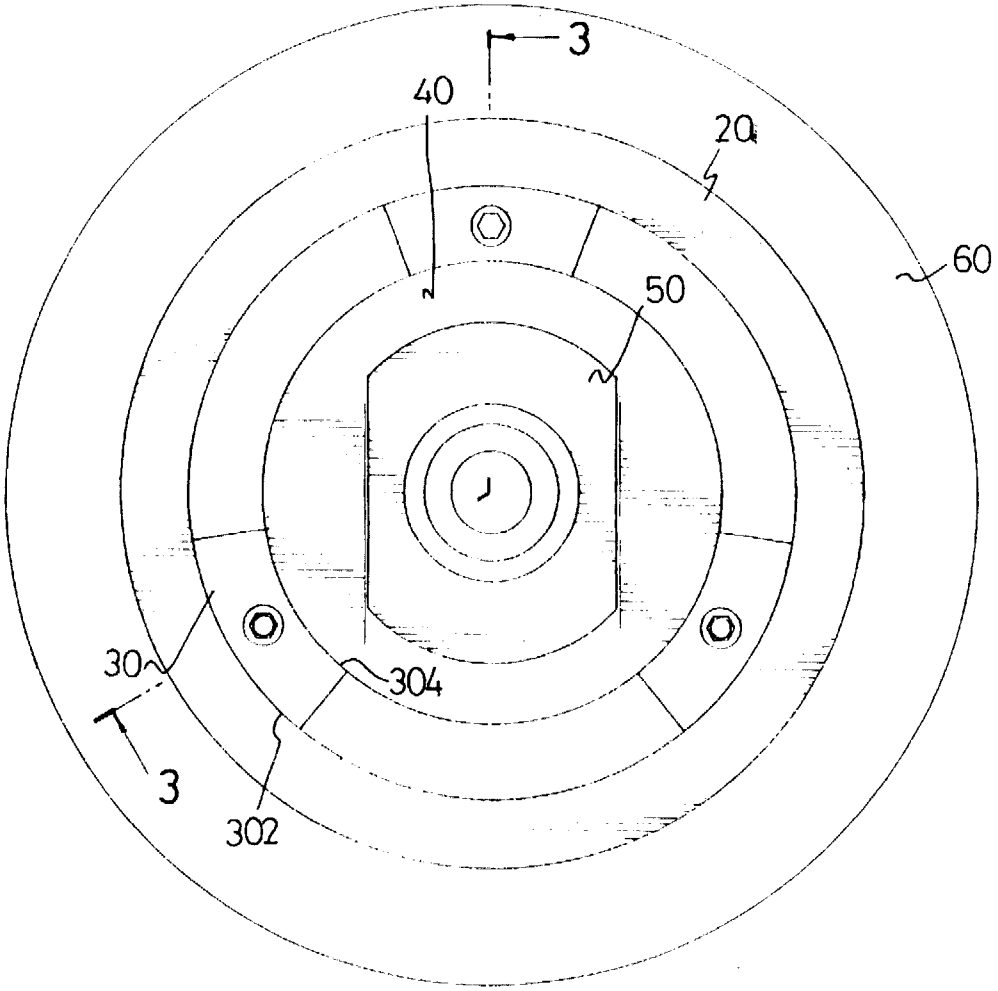
FIG. 2 is a front view of FIG. 1 showing that the elements of FIG. 1 and a grinding wheel are assembled together.
Figure 5:
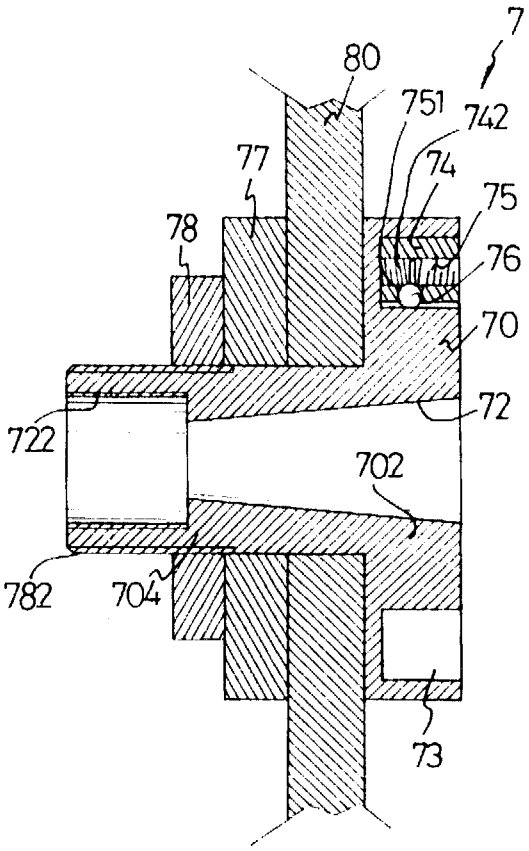
FIG. 5 PRIOR ART
FIG. 5 is a cross-sectional view taken from line 5—5 of FIG. 4.
Figure 4:
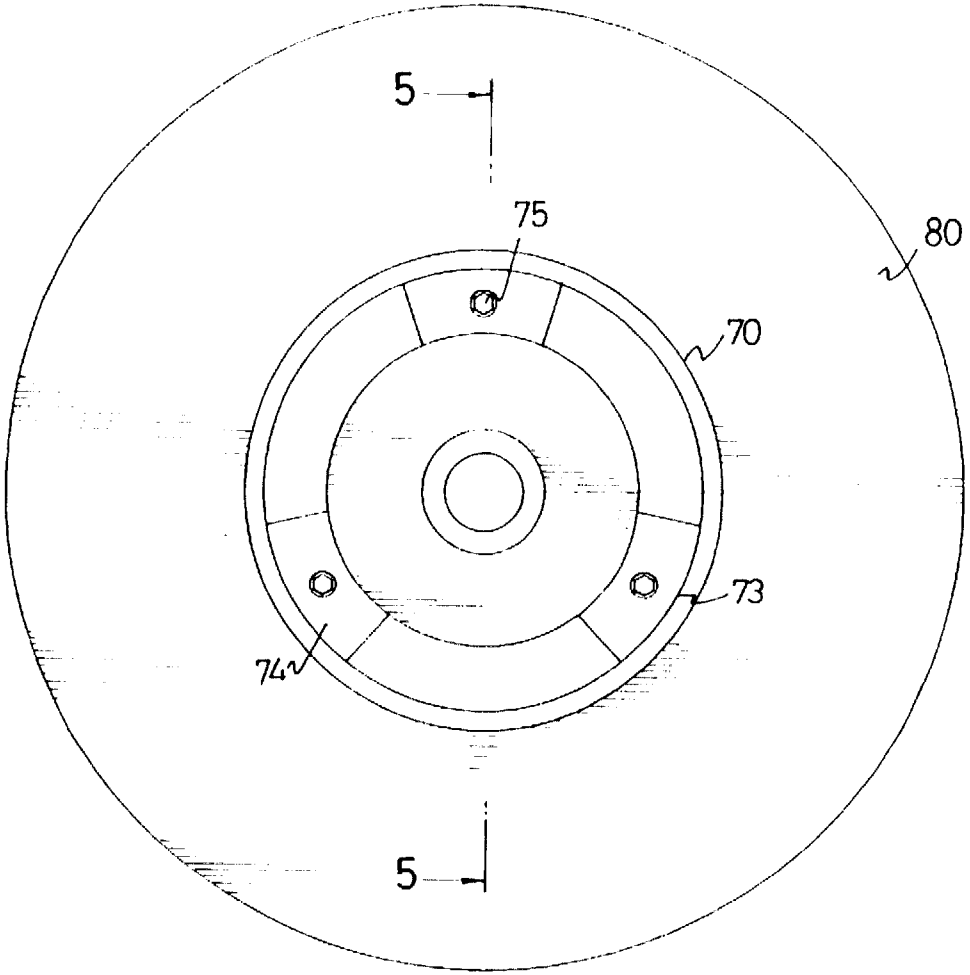
FIG. 4 PRIOR ART
FIG. 4 is a view similar to FIG. 2 but showing a prior art sleeve flange type mounting device for mounting a grinding wheel on a spindle of a grinding machine and a grinding wheel.

Referring to FIGS. 1 to 3, a sleeve flange type mounting device 1 (hereafter termed as "mounting device") for mounting a grinding wheel 60 to a spindle (not shown) of a grinding machine (not shown) in accordance with the present invention consists of a sleeve flange 10 defining a flange portion 11 and a sleeve portion 12 extending centrally and forwardly from the flange portion 11. A circular pressing plate 20 has a front face 204 defining a circular recess 26 therein, a central stepped portion 22 and a locating ridge 25 protruding from stepped portion 22 and positioned around a first central hole 24 axially extending through the pressing plate 20. Three balance weights 30 each are equipped with a screw 32 extending through a passage from a front face toward a rear face thereof. A circular cover 40 defines a second central hole 421. A nut 50 defines a large screw hole 51.

The sleeve portion 12 defines a thread on an outer extremity thereof which is used to engage with the large screw hole 51 of the nut 50 when the above mentioned elements constituting the mounting device 1 and the grinding wheel 60 are assembled together. The sleeve flange 10 further defines a tapered hole 13 and a small screw hole 14 for attaching the mounting device 1 together with the grinding sleeve 60 to an extremity of the spindle which has a corresponding structure.

The pressing plate 20 further defines a convex portion 21 on its rear face which is used to engage the grinding wheel 60 when the grinding wheel 60 is assembled with the mounting device 1.

The recess 26 is defined by a far wall 221 located near a circumferential periphery of the pressing plate 20 and inclined outwardly toward the rear face of the pressing plate 20 and terminating at a first end of a base wall 262, a middle wall 264 located substantially parallel to the far wall 221 and terminating at a second end of the base wall 262 and the central stepped portion 22 extending between the middle wall 264 and the locating ridge 25. The far wall 221 is inclined by a first degree of sloping.

Each of the balance weights 30 is configured to have generally an arc-shaped configuration defining a first arc-shaped side 302 having a first radius of curvature substantially the same as that of the far wall 221, and a second arc-shaped side 304 having a second radius of curvature substantially the same as that of a circumferential periphery 411 of the cover 40. Furthermore, the first arc-shaped side 302 is inclined from the front face of the balance weight 30 toward the rear face thereof by a second degree of sloping. The second degree of sloping is substantially the same as the first degree of sloping defined by the far wall 221. The second side 304 is inclined from the front face of the balance weight 30 toward the rear face thereof in a manner that the distance between the first arc-shaped side 302 and second arc-shaped side 304 is gradually increased from the front face of the balance weight 30 to the rear face thereof. The second side 304 is inclined by a third degree of sloping.

The circumferential periphery 411 of the cover 40 is inclined inwardly toward a rear of the cover 40 by a fourth degree of sloping wherein the fourth degree of sloping is substantially the same as the third degree of sloping defined by the second arc-shaped side 304 of each of the balance weights 30.

When assembling the elements of the mounting device 1 together with the grinding wheel 60, firstly, the sleeve portion 12 of the sleeve flange 10 is brought to extend through a central hole of the grinding wheel 60 and then the first central hole 24 of the pressing plate 20. Thereafter, the balance weights 30 are brought to be positioned in the recess 26 in a manner that the first arc-shaped side 302 of each of the balance weights 30 abuts against the far wall 221, the front face thereof is located near the front face 204, and the rear face thereof is located near the base wall 262. Subsequently, the cover 40 is brought to be attached to the pressing plate 20 wherein a wall of the cover 40 defining the second central hole 421 is matingly fitted with the locating ridge 25 and the circumferential periphery 411 of the cover 40 abuts against the second arc-shaped side 304 of each of the balance weights 30. Then, the nut 50 is brought to threadedly engage with the extremity of the sleeve portion 12 and exert a compressive force on the cover 40 to connect the sleeve flange 10, grinding wheel 60, pressing plate 20, balance weights 30 and cover 40 together in which the balance weight 30 are free to move along the recess 26 but not allowed to escape therefrom. Thereafter, the screws 32 in the balance weights 30 are screwed in against the base wall 262 to exert a pushing force thereon and cause the balance weights 30 to move forwardly to a position wherein the balance weights 30 are tightly compressed between the far wall 221 of the pressing plate 20 and the circumferential periphery 411 of the cover 40 whereby the balance weights 30 are locked in place. Finally, the mounting device 1 together with the grinding wheel 60 is brought to be mounted on the spindle of the grinding machine and a static balance and a dynamic balance of the mounting device 1 together with the grinding wheel 60 are tested whereby the position of the balance weights 30 can be adjusted until an optimum static and dynamic balance is obtained.

In the present invention, when the grinding wheel 60 is worn and needs to be replaced with a new one, the nut 50 is slackened and moved away from the sleeve portion 12 wherein the cover 40 can be taken away from the sleeve portion 12 and the balance weights 30 can be taken out of the groove 26 without the undue work of the prior art to manipulate the screws 32 extending through the balance weights 30, whereby the dust/particles generated by the grinding operation of the grinding wheel 60 and accumulated in the groove 26 can be easily removed. Furthermore, since the present invention does not need the use of steel balls to lock the balance weights in place, the problem of the prior art to adjust the position of the balance weights being very troublesome due to the passage for the steel balls to move being blocked so that the steel balls are held on the position locking the balance weights in place will not happen in the present invention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sleeve flange type mounting device for mounting a grinding wheel on a spindle of a grinding machine, comprising:

a sleeve flange defining a flange portion and a sleeve portion projecting from the flange portion and defining an extremity having an outer thread formed thereon, said sleeve flange further defining a means for attaching the sleeve flange to the spindle;

a circular pressing plate for clamping the grinding wheel on the flange portion, comprising:

a first side for engaging with the grinding wheel;, a second side opposite to the first side and defining a circular recess therefrom toward the first side;

a base wall located between the first side and second side;

a far wall located near a circumferential periphery of the pressing plate and inclined outwardly toward the first side of the pressing plate and terminating at a first end of the base wall;

a central stepped portion protruding from the base wall and located about a center of the pressing plate and defining a middle wall, said middle wall substantially parallel to the far wall and terminating at a second end of the base wall; and a first central hole axially extending through the pressing plate, said sleeve portion being extended through the first central hole, wherein said far wall, base wall, middle wall and central stepped portion cooperatively form a recess from the second side of the pressing plate toward the first side thereof;

a plurality of arc-shaped balance weights received in the recess, each balance weight defining a first arc-shaped side abutting against the far wall, a front face located near the second side of the pressing plate, a rear face located near the base wall and a second arc-shaped side opposing the first arc-shaped side and inclined from the front face of the balance weight toward the rear face thereof in a manner that the distance between the first arc-shaped side and second arc-shaped side is gradually increased from the front face of the balance weight to the rear face thereof;

a plurality of screws respectively extending through the balance weights from the front face to the rear face thereof and exerting a pushing force on the base wall;

a circular cover attached to the pressing plate and having a circumferential periphery abutting against the second arc-shaped side of each of the balance weights; and a nut threadedly engaging with the extremity of the sleeve portion and exerting a compressive force on the cover.

2. The sleeve flange type mounting device in accordance with claim 1, wherein the first side of the pressing plate defining a convex portion for engaging with the grinding wheel.

3. The sleeve flange type mounting device in accordance with claim 1, wherein the pressing plate further includes a locating ridge located around the first central hole and protruding from the central stepped portion and the cover defines a second central hole, a wall of the cover defining the second central hole being matingly fitted with the locating ridge.

4. The sleeve flange type mounting device in accordance with claim 1, wherein the means for attaching the sleeve flange to the spindle comprises a screw hole located in the sleeve portion about the extremity thereof and a tapered hole extending from the screw hole through the flange portion.

* * * * *